US007110697B2

(12) United States Patent
Jeon

(10) Patent No.: US 7,110,697 B2
(45) Date of Patent: Sep. 19, 2006

(54) DEVELOPER LAYER THICKNESS REGULATING DEVICE FOR A DEVELOPING UNIT

(75) Inventor: In-Cheol Jeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/048,927

(22) Filed: Feb. 3, 2005

(65) Prior Publication Data

US 2005/0244185 A1 Nov. 3, 2005

(30) Foreign Application Priority Data

Apr. 29, 2004 (KR) ..... 10-2004-0029871

(51) Int. Cl.
*G03G 15/00* (2006.01)

(52) U.S. Cl. ..... 399/103; 399/199; 399/274

(58) Field of Classification Search ..... 399/103, 399/119, 274
See application file for complete search history.

(56) References Cited

U.S. PATENT DOCUMENTS 5,587,551 A * 12/1996 Ikegawa et al. ..... 399/284
6,496,669 B1 * 12/2002 Sato et al. ..... 399/103
6,574,444 B1 * 6/2003 Uehara et al. ..... 399/103
2002/0090226 A1 * 7/2002 Sato et al. ..... 399/103

FOREIGN PATENT DOCUMENTS

| | | |
|---|---|---|
| JP | 05-002322 | 1/1993 |
| JP | 06-308819 | 11/1994 |
| JP | 07-301991 | 11/1995 |
| JP | 11-327294 | 11/1999 |
| JP | 2000-181223 | 6/2000 |
| KR | 1987-0008234 | 9/1987 |
| KR | 2003-0092320 | 12/2003 |

* cited by examiner

*Primary Examiner*—David M. Gray
*Assistant Examiner*—Joseph S. Wong
(74) *Attorney, Agent, or Firm*—Roylance, Abrams, Berdo & Goodman, L.L.P.

(57) ABSTRACT

A developer layer thickness regulating device for a developing unit improves the sealing effect of a developer by regulating a thickness of a developer layer formed on a developing roller. The device includes a blade having a blade body that is in resilient contact with the developing roller. A bent part is formed on the blade body and extends at a predetermined angle from a developing roller contact part that is in contact with the developing roller, and a recessed part formed on the bent part. A sealing member is in contact with the blade. The sealing member overlaps with the recessed part.

11 Claims, 5 Drawing Sheets

DEVELOPER LAYER THICKNESS REGULATING DEVICE FOR A DEVELOPING UNIT

This application claims the benefit under 35 U.S.C. § 119(a) of Korean Patent Application No. 2004-29871, entitled "A Developer-Layer Device and a Developing Unit Having the Developer-Layer Device," filed on Apr. 29, 2004 with the Korean Intellectual Property Office, the entire contents of which are hereby incorporated by reference.

BACKGROUND OF THE INVENTION

1. Field of the Invention

The present invention relates generally to an image forming apparatus. More particularly, to a device for regulating a thickness of a developer layer formed on a developing roller of a developing unit.

2. Description of the Related Art

In general, an image forming apparatus using a one-component nonmagnetic developer includes a blade that is in contact with a developing roller. A developer layer remains on the developing roller and has a predetermined thickness. FIG. 1 illustrates an example of a developing unit employing the blade.

Referring to FIG. 1, a photosensitive drum 112 is installed in a housing 104 and has a predetermined shape. The surface of the photosensitive drum 112 is charged with a predetermined electric potential by a charging roller 114. The charged surface of the photosensitive drum 112 is partially exposed to light by a laser scanning unit 160 to form an electrostatic latent image. A developer is accommodated in a toner accommodating part 105 of the housing 104, and is supplied to the developing roller 110. The toner accommodating part 105 is provided with an agitator 106 for agitating the developer. A developer supplying roller 108 is in contact with the developing roller 110, and is rotated in the same counterclockwise direction as a rotational direction of the developing roller for supplying the developer to the developing roller 110. In the instant case, blade 124 is in contact with the developing roller 110 for regulating the thickness on the developer adhered to the surface of the developing roller 110.

The blade 124 is made of a metal sheet having a predetermined thickness suitable for having an elastic force. The blade 124 applies a substantially constant pressure to the developing roller 110. The contacting pressure, caused by the elastic force, is applied to the developer passing between the blade 124 and the developing roller 110. Thus, the developer is charged with a predetermined polarity by friction.

The charged developer collides with a bent part 128 of the blade 124 for a predetermined period of time for charging. The developer 128 accumulates on the bent part and overcomes the elastic force of the blade 124. Consequently, the developer 128 passes between the blade 124 and the developing roller 110 to form a developer layer having a constant thickness.

Referring to FIG. 2, the blade 124 is welded to a bracket 122 having a high rigidity by spot welding. The blade 124 is provided at both ends thereof with sealing members 130 for preventing the developer from accumulating on the bent part 128 of the blade 124 and leaking into the housing. However, if the sealing members 130 overlap with both ends of the blade 124, estimating the pressure exerted on the developing roller 110 of the blade 124 during blade design is impossible. For this reason, it is preferable that the sealing members 130 are in contact with both ends of the blade 124.

The resultant structure is possible to design, however; a gap G is produced between the sealing member 130 and the end of the blade 124 due to an assembling error which occurs during the manufacturing process. This gap G results in the formation of an unregulated developer layer 111, causing developer loss to occur, thus polluting both ends of the photosensitive drum 112 (FIG. 1) and the interior of the image forming apparatus. Furthermore, concentrations of the developer accumulate on both sides of a wasted toner reservoir (not shown) by the unregulated developer, and this causes the cleaning performance to deteriorate.

Accordingly, there is a continual need for a developer layer thickness regulating device for a developing unit that improves the sealing effect of a developer by regulating a thickness of a developer layer formed on a developing roller.

SUMMARY OF THE INVENTION

The present invention solves the above drawbacks and other problems associated with a conventional device for regulating a thickness of a developer layer formed on a developing roller. An aspect of the present invention is to provide a device for regulating a thickness of a developer layer formed on a developing roller which improves the sealing characteristic of a developer.

The foregoing and other aspects and advantages are substantially realized by providing a device for regulating a thickness of a developer layer formed on a developing roller. The device comprises a blade having a blade body that is in resilient contact with the developing roller. A bent part is formed on the blade body and extends at a predetermined angle from a developing roller contact part being in contact with the developing roller. A recessed part is formed on the bent part and a sealing member is in contact with the blade. The sealing member overlaps with the recessed part.

Here, it is preferable that the bent part has first and second ends, and the recessed part is formed on each end.

It is also preferable that a longitudinal length L1 of the recessed part is longer than a length L2 of a sealing-member contact part through which the sealing member contacts with the recessed part.

It is also preferable that a transverse length W2 of the recessed part is shorter than a length W1 from the developing-roller contact part to a free end of the bent part.

It is also preferable that the transverse length W2 of the recessed part is within about 0.1 mm.

It is also preferable that the sealing member is adhered to at least one of the blade body and the bent part by an adhesive.

According to another aspect of the present invention, there is provided a developing unit comprising a housing, a photosensitive medium provided inside the housing, and a developing roller for developing a developer on a surface of the photosensitive medium. Also, a blade having a blade body being in resilient contact with the developing roller is provided. A bent part is formed on the blade body and extends at a predetermined angle from a developing-roller contact part and is in contact with the developing roller. A recessed part is formed on the bent part and a sealing member is in contact with the blade. The sealing member overlaps with the recessed part.

Here, it is preferable that the bent part has first and second ends, the recessed part is formed on each end.

It is also preferable that a longitudinal length L1 of the recessed part is longer than a length L2 of a sealing-member contact part through which the sealing member contacts with the recessed part.

It is also preferable that a transverse length W2 of the recessed part is shorter than a length W1 from the developing-roller contact part to a free end of the bent part.

It is also preferable that the transverse length W2 of the recessed part is within about 0.1 mm.

It is also preferable that the sealing member is adhered to at least one of the blade body and the bent part by an adhesive.

It is also preferable that the developing unit further comprises a bracket which is installed in the housing and to which the blade is fixed.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of aspects of the present invention will become more apparent from the following description taken in conjunction with the accompanying drawings in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the invention. Accordingly, those of ordinary skill in the art will recognize that various changes and modifications of the embodiments described herein can be made without departing from the scope and spirit of the invention. Also, descriptions of well-known functions or constructions are omitted for conciseness.

Figure 1:
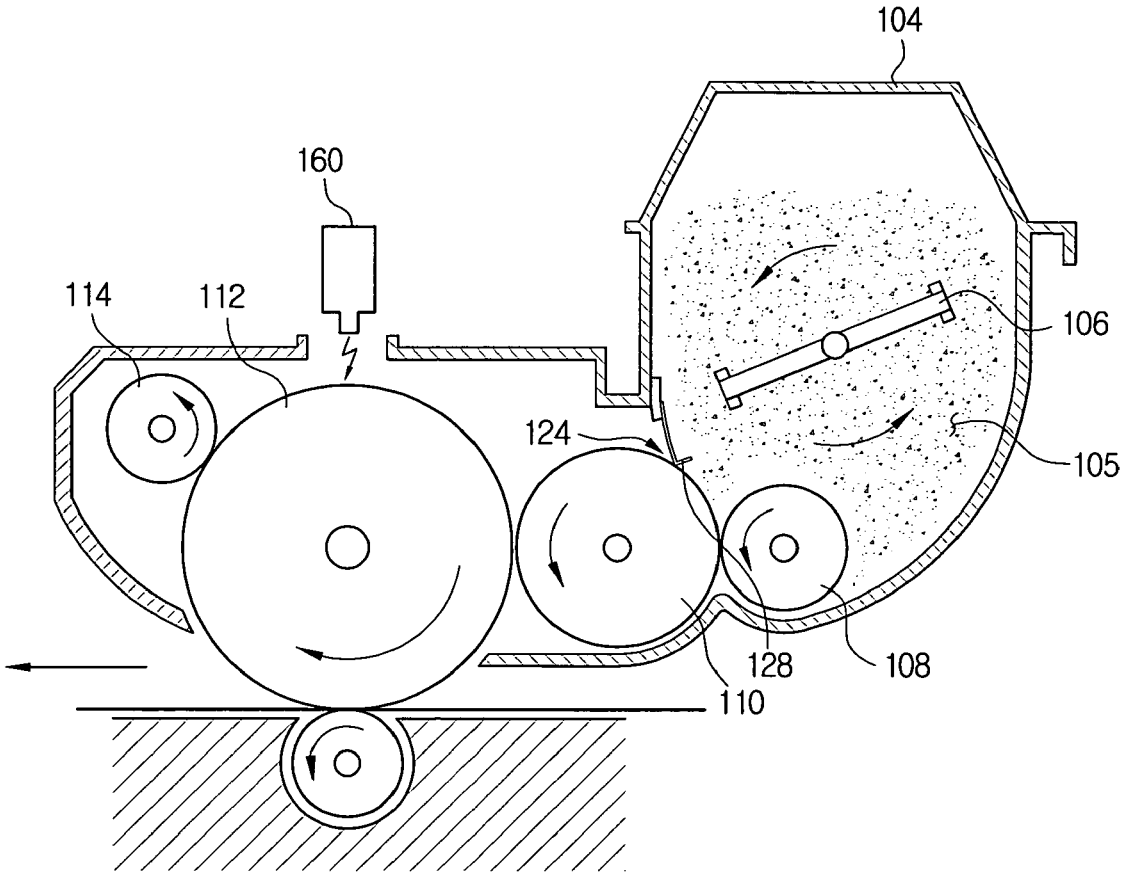
FIG. 1 (PRIOR ART)
FIG. 1 is a cross-sectional view schematically illustrating a conventional developing unit.
Figure 2:
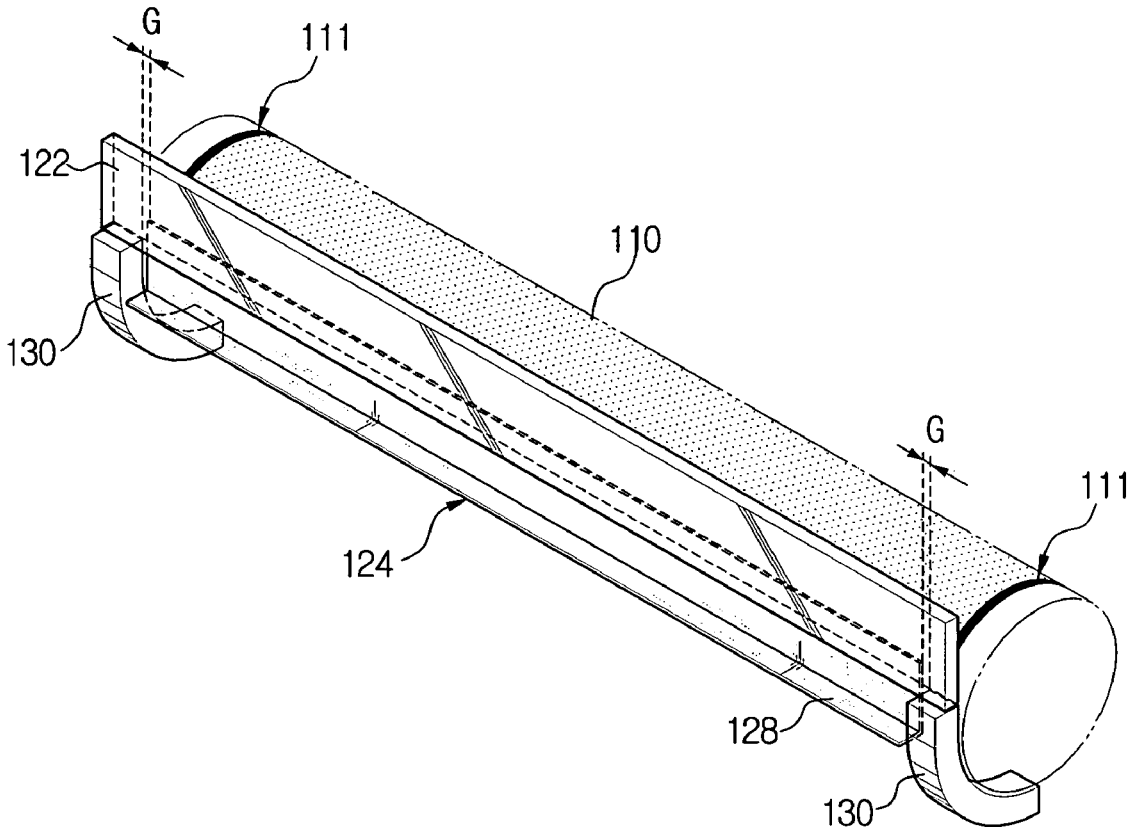
FIG. 2 (PRIOR ART)
FIG. 2 is a perspective view of a major part in FIG. 1.
Figure 3:
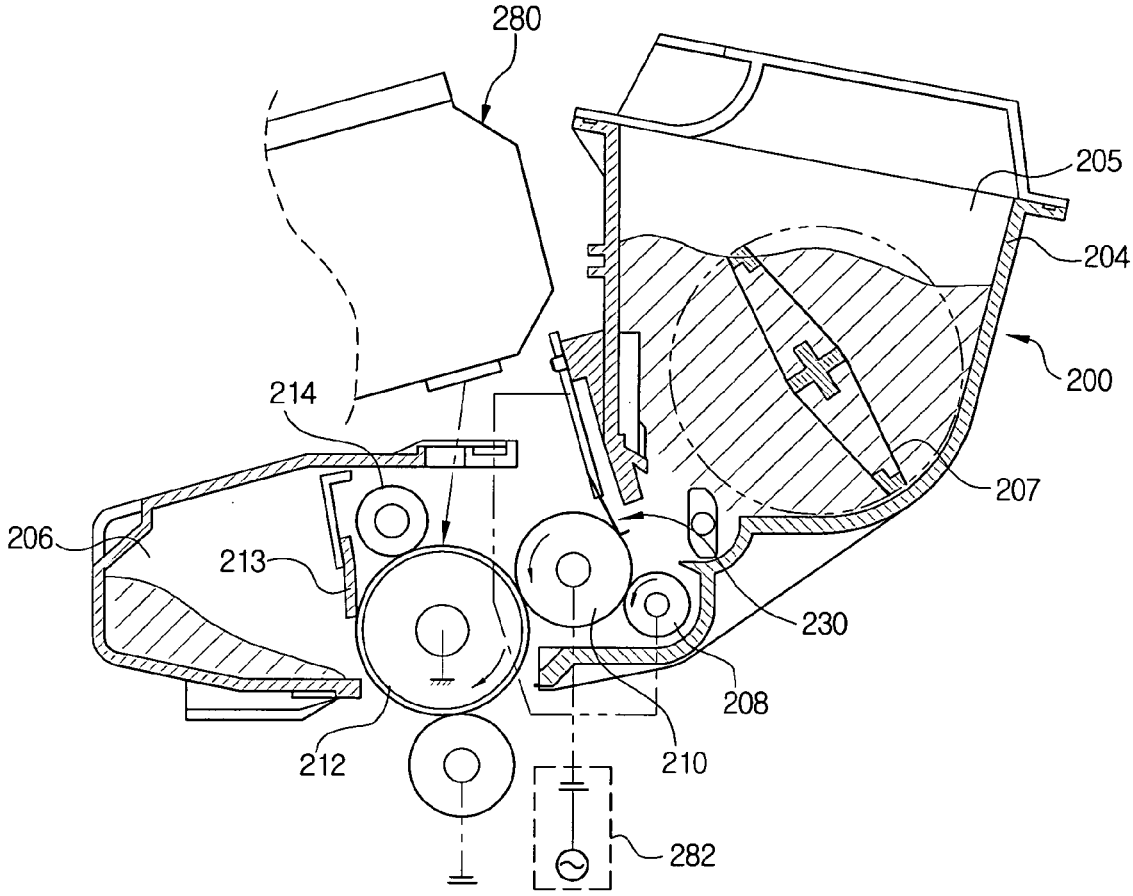
FIG. 3 is a cross-sectional view schematically illustrating a developing unit in accordance with an embodiment of the present invention.

Referring to FIG. 3, a developing unit 200 according to an embodiment of the present invention includes a housing 204, a photosensitive drum 212 installed in the housing 204, a developing roller 210 for supplying a developer to the photosensitive drum 212, a supply roller 208 for supplying the developer to the developing roller 210, and a device for regulating a thickness of a developer layer formed on the developing roller 210.

The housing 204 is divided into a toner accommodating part 205 and a wasted-developer accommodating part 206. The toner accommodating part 205 is for accommodating the developer to be used for the development, and the wasted-developer accommodating part 206 is for accommodating the wasted developer. An agitator 207 is rotatably installed in the toner accommodating part 205.

The photosensitive roller 212 rotatably contacts a charging roller 214. The charging roller 214 charges a surface of the photosensitive roller 212 with a predetermined potential. The charged surface of the photosensitive roller 212 is exposed to a beam radiated from a laser scanning unit 280 to form an electrostatic latent image. Also, a cleaning blade 213 is in contact with the photosensitive drum 212 to remove wasted developer on the photosensitive drum 212.

The developing roller 210 is rotatably installed on the photosensitive drum 212 with a predetermined developing gap formed between the developing roller 210 and the photosensitive drum 212. The developing roller 210 receives an AC voltage and a DC voltage applied from a power supply 282. The developer on the surface of the developing roller 210 passes through the developing gap and then moves to an electrostatic latent image area of the photosensitive drum 212 by an electric potential difference.

The supply roller 208 rotates in the same, preferably counterclockwise, direction of the developing roller 210 to supply the developer from the developer accommodating part 205 to the developing roller 210.

Figure 4:
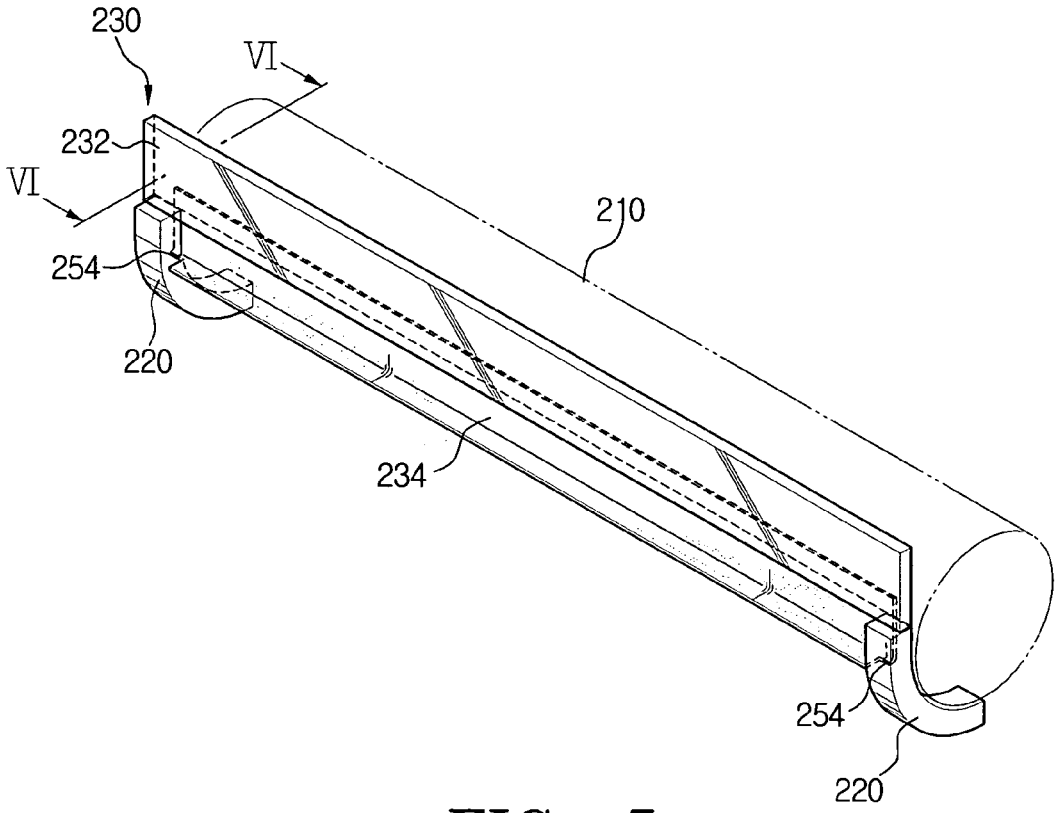
FIG. 4 is a perspective view of a major part of the developing unit as shown in FIG. 3.

Referring to FIG. 4, the device for regulating the thickness of the developer layer 230 includes a bracket 232 fixed to the housing 204 (FIG. 3). A blade 234 is welded to the bracket by fixing means such as a spot welding for regulating the thickness of the developer layer. Preferably, the blade 234 is typically made of a metal having a predetermined elastic force that it is in contact with the developing roller 210. Alternatively, an elastic member (e.g. rubber) may be used as a material of the blade. The blade 234 is provided at both ends thereof with sealing-member contacts 254. A sealing member 220 is attached to the sealing-member contact 254 to prevent the developer from leaking into the front and sides of the housing 204. Accordingly, the sealing member 220 overlaps with the blade 234 to prevent the developer from leaking to the front of the housing. Preferably, the sealing member 220 is made of a soft and elastic material such as a sponge.

Figure 5:
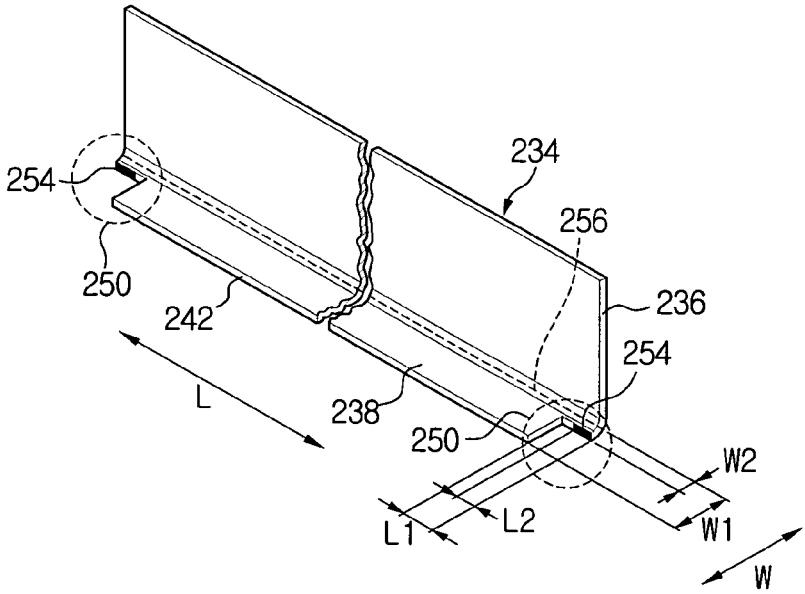
FIG. 5 is a perspective view of a blade of the major part shown in FIG. 4.

Referring to FIG. 5, the blade 234 includes a blade body 236 with its upper part fixed to the bracket 232 (FIG. 4) by spot welding. A bent part 238 extends at a predetermined angle from the blade body 236. Preferably, the bending angle is in the range of about 10 to 170 degrees, but is not limited thereto. A corner at which the blade body 236 and the bent part 238 meet together, is rounded and has a predetermined radius R, such that the corner is in linear contact with the developing roller 210 (FIG. 3). The bent part 238 is provided at both ends thereof with a recessed part 250. The recessed part 250 is formed with the sealing-member contact 254 in a longitudinal direction L of the recessed part that is in contact with the sealing member 220 (FIG. 4). A length L2 of the sealing-member contact 254 is shorter than a cutting length L1 in the longitudinal direction L for preventing the sealing member 220 from overlapping with an uncut portion of the bent part 238. If the sealing member 220 overlaps with the uncut portion of the bent part 238, the sealing member 220 compresses the blade 234. Since this compression may not be considered in design, the developing roller 210 (FIG. 4) is excessively pressed through the blade 234. For this reason, preferably, the cutting length L1 is longer than the length L1 of the sealing-member contact 254.

Both ends of the bent part 238 formed on the blade 234 are cut in a width direction W. Preferably, a length W2 taken from a developing-roller contact 256 to the sealing-member contact 254 is not more than 0.1 mm after cutting. This minimizes pressure applied to the blade 234 by the sealing member 220. The length W2 taken from a contact line of the developing roller 210 to the sealing-member contact 254 is shorter than a length W1 from the developing-roller contact to a free end 242 of the bent part 238. The term "cutting" is for convenience'sake in understanding, however, it is understood by one having ordinary skill that the recessed part may also be formed by casting.

Figure 6A:
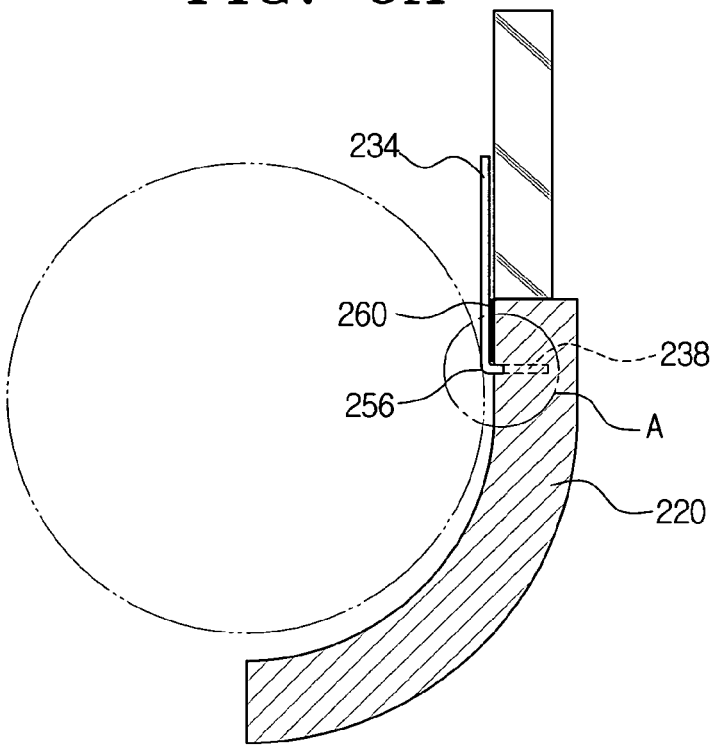
FIG. 6A is a cross-sectional view taken along a line VI—VI in FIG. 4.
Figure 6B:
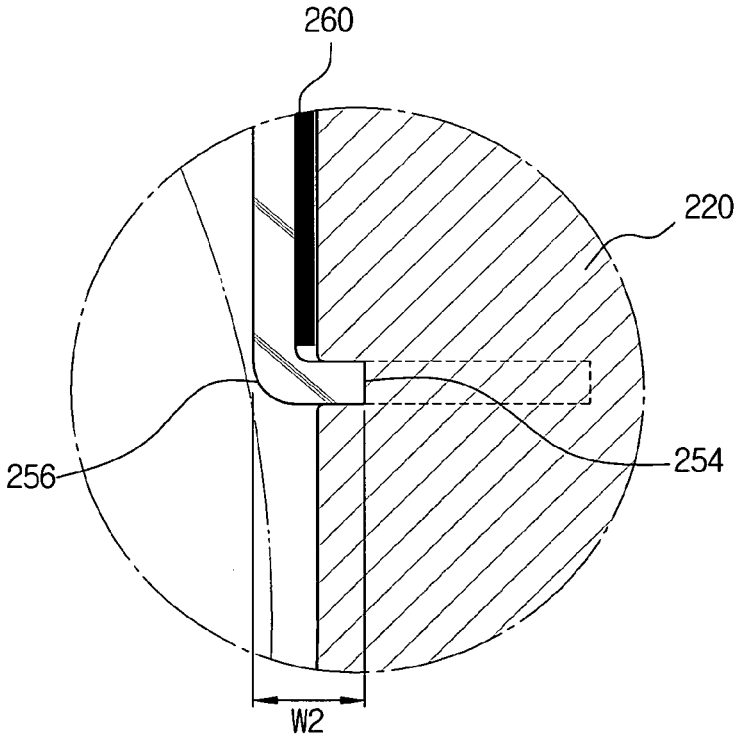
FIG. 6B is an enlarged cross-sectional view of a part A shown in FIG. 6A.

FIGS. 6A and 6B depict the blade 234 adhered to the sealing member 220. Referring to FIGS. 6A and 6B, the blade 234 is adhered to the sealing member 234 by an adhesive 260. The adhesive 260 comprises double-sided tape and a thin sealing member. The adhesive prevents unexpected pressure from being exerted on the blade 234 by the sealing member 220 when the sealing member 220 is compressed and contacts the blade 234. Also, the sealing-member contact 254, which is a portion of the recessed part 250 formed at both ends of the bent part 238, is inserted into the sealing member 220. The sealing member 220 may include a groove formed thereon for receiving the bent part 238 so as to prevent the blade 238 from being unexpectedly pressed by the elastic force of the sealing member 220. However, if the sealing member is made of a soft and elastic material, the length W2 from the developing-roller contact 256 to the sealing-member contact 254 is minimized. In this case, since the pressure exerted on the blade by the sealing member 220 is negligible, no additional groove is required. The structure as described above can prevent the developer from leaking through the front and sides of the developing unit.

As described above, aspects of the present invention may prevent the developer from leaking through the front and sides of the blade for regulating the thickness of the developer layer in the housing of the developing unit. Therefore, embodiments of the present invention may improve the sealing effect and thereby prevent the loss of the developer. In addition, preferred embodiments of the present invention may reduce contamination at both ends of the photosensitive drum, thereby preventing accumulation of the toner at both sides of the wasted-developer reservoir. Moreover, deterioration of cleaning performance and contamination of the charging means and internal contamination of the image forming apparatus is prevented.

While the invention has been shown and described with reference to certain embodiments thereof, it will be understood by those skilled in the art that various changes in form and details may be made therein without departing from the spirit and scope of the invention as defined by the appended claims.

What is claimed is:

1. A device for regulating a thickness of a developer layer formed on a developing roller, the device comprising:

a blade having a blade body being in resilient contact with the developing roller, a bent part formed on the blade body and extending at a predetermined angle from a developing roller contact part that is in contact with the developing roller, and a recessed part formed on the bent part, the recessed part having a longitudinal length (L1); and a sealing member contacting the blade, the sealing member overlapping and contacting the recessed part along a sealing member contact part, the longitudinal length (L1) of the recessed part being longer than a length (L2) of the sealing member contact part.

2. The device as claimed in claim 1, wherein the bent part has first and second ends, and the recessed part is formed on each end.

3. The device as claimed in claim 1, wherein a transverse length (W2) of the recessed part is shorter than a length (W1) from the developing roller contact part to a free end of the bent part.

4. The device as claimed in claim 3, wherein the transverse length (W2) of the recessed part is within about 0.1 mm.

5. The device as claimed in claim 1, wherein the sealing member is adhered to at least one of the blade body and the bent part by an adhesive.

6. A developing unit comprising:

a housing;

a photosensitive medium provided inside the housing;

a developing roller for developing a developer on a surface of the photosensitive medium;

a blade having a blade body being in resilient contact with the developing roller, a bent part formed on the blade body and extending at a predetermined angle from a developing roller contact part that is in contact with the developing roller, and a recessed part formed on the bent part, the recessed part having a longitudinal length (L1); and a sealing member contacting the blade, the sealing member overlapping and contacting the recessed part along a sealing member contact part, the longitudinal length (L1) of the recessed part being longer than a length (L2) of the sealing member contact part.

7. The developing unit as claimed in claim 6, wherein the bent part has first and second ends, the recessed part is formed at each end of the bent part.

8. The developing unit as claimed in claim 6, wherein a transverse length (W2) of the recessed part is shorter than a length (W1) from the developing-roller contact part to a free end of the bent part.

9. The developing unit as claimed in claim 8, wherein the transverse length (W2) of the recessed part is within about 0.1 mm.

10. The developing unit as claimed in claim 6, wherein the sealing member is adhered to at least one of the blade body and the bent part by an adhesive.

11. The developing unit as claimed in claim 6, further comprising a bracket that is installed in the housing and to which the blade is fixed.

* * * * *